US006851347B1

(12) United States Patent
Plunkett

(10) Patent No.: US 6,851,347 B1
(45) Date of Patent: Feb. 8, 2005

(54) MULTI-LOBED BUOYANT LAUNCH CAPSULE

(75) Inventor: Stephen J. Plunkett, Middletown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/456,245

(22) Filed: Jun. 5, 2003

(51) Int. Cl.[7] ..... F41F 3/07

(52) U.S. Cl. ..... 89/1.81; 89/1.806; 89/1.815; 89/1.817; 89/1.819

(58) Field of Search ..... 89/1.816, 1.817, 89/1.818, 1.809, 1.81, 1.815, 1.806, 1.819

(56) References Cited

U.S. PATENT DOCUMENTS

| | | | | | |
|---|---|---|---|---|---|
| 2,514,364 | A | * | 7/1950 | Bates | 206/3 |
| 3,137,203 | A | * | 6/1964 | Brown | 89/1.81 |
| 3,158,062 | A | * | 11/1964 | Feiler | 89/1.81 |
| 3,295,411 | A | * | 1/1967 | Lehmann | 89/1.81 |
| 3,673,916 | A | | 7/1972 | Wittholz | |
| 3,706,260 | A | * | 12/1972 | Rausing | 89/35.01 |
| 3,939,967 | A | * | 2/1976 | Tenney et al. | 206/3 |
| 4,137,819 | A | | 2/1979 | Loomis, III | |
| 4,646,618 | A | | 3/1987 | Kurth et al. | |
| 4,878,416 | A | | 11/1989 | Orquera et al. | |
| 4,940,135 | A | * | 7/1990 | Hall | 206/3 |
| 5,058,481 | A | * | 10/1991 | Drummond et al. | 89/1.816 |
| 5,115,711 | A | | 5/1992 | Bushagour et al. | |
| 5,316,462 | A | | 5/1994 | Seemann | |
| 5,439,635 | A | | 8/1995 | Seemann | |
| 5,601,852 | A | | 2/1997 | Seemann | |
| 5,702,663 | A | | 12/1997 | Seemann | |
| 6,164,179 | A | * | 12/2000 | Buffman | 89/1.81 |

FOREIGN PATENT DOCUMENTS

| | | | | |
|---|---|---|---|---|
| DE | 2 424 480 | * | 12/1974 | 89/1.817 |

* cited by examiner

*Primary Examiner*—Stephen M. Johnson
(74) *Attorney, Agent, or Firm*—James M. Kasischke; Michael P. Stanley; Jean-Paul Nasser

(57) ABSTRACT

A launch capsule assembly having a buoyant main body for a payload of a missile or other unmanned vehicle. The main body includes a plurality of lobes contributing to its interior. The lobes project perpendicular to and away from the longitudinal axis of the main body with the interior of each projecting lobe sized to accommodate at least one projecting fin of the payload. The top of the main body removably attaches to a top cap projecting hydrodynamically from the main body. The bottom of the main body removably attaches to a bottom cap machined to have a matching cross-section to the main body of the capsule.

8 Claims, 5 Drawing Sheets

MULTI-LOBED BUOYANT LAUNCH CAPSULE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to an assembly that will launch a missile or other unmanned aerial vehicles and more specifically to a multi-part launch capsule with projecting lobes along the length of the capsule in which the lobes are capable of encompassing the fixed wings of a missile or the fixed wings of other unmanned aerial vehicles.

(2) Description of the Prior Art

It is generally known in the art that launch capsules are cylindrically shaped with the length of the cylinder being longer than the length of the payload of a missile or unmanned aerial vehicle. As such, known launch capsule construction requires very long capsules with an inside diameter that is larger than the tip-to-tip wingspan of the payload. Although launch capsules that are slightly longer than the vertical payload length can be made buoyant, the length over the diameter ratio is often too low to allow a stable ascent when the capsule is launched from an underwater structure.

Adding fins to the outside of the launch capsule compensates the length to diameter ratio and thereby enhances a stable ascent of the capsule. However, by adding fins to the capsule or by increasing the overall length of the capsule, the ability to stack multiple capsules either side-by-side or vertically is limited.

An improvement to the structure of existing launch capsules would be the ability to increase the storing or stacking numbers of multiple launch capsules while maintaining or enhancing the stability of the capsules during a buoyant ascent. The stability of the launch capsule should not require the addition of fins to the capsule and should not require an increase in the length of the capsule.

An additional improvement to the formation of launch capsules would be the use of materials that are more cost-effective and are more environmentally conscious than those materials presently used in the formation of launch capsules.

SUMMARY OF THE INVENTION

Accordingly, the present invention comprises a launch capsule assembly with a main body for housing the payload, a top cap positioned on a top end of the main body and a bottom cap positioned on a bottom end of the main body. The main body includes a plurality of lobes as contributing to the interior of the body. The lobes project perpendicularly away from the longitudinal axis of the body with the interior of each projecting lobe sized to accommodate at least one projecting fin of the payload. The projecting lobes which extend the length of the main body increase the stability of the launch capsule assembly while it travels to the surface under its buoyant force.

The top cap removably attaches to the top of the main body wherein the top cap projects hydrodynamically from an open end of the main body. The top cap is jettisoned prior to launch. The bottom cap removably attaches to the bottom of the main body. The bottom cap is used for the launch of the missile when the capsule broaches the water surface and can be removable for access to the interior of main body during assembly. In addition, the bottom cap can have a matching cross-section to the main body of the capsule.

The main body is formed to be a buoyant elongated structure capable of storing the payload of a missile or other unmanned vehicle. Preferably, the main body is formed by infusing a fiberglass cloth resin over a male mandrel. By infusing the fiberglass cloth, the launch capsule assembly is formed to be buoyant in a cost-effective and more environmentally conscious manner than by known methods of forming launch capsules such as by filament wound mandrels.

Additionally, the fiberglass cloth may be infused with epoxy or vinyl ester in circumstances that require additional strengthening of the main body. Alternatively, a graphite/epoxy composite may be infused on the mandrel in lieu of fiberglass cloth resin.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
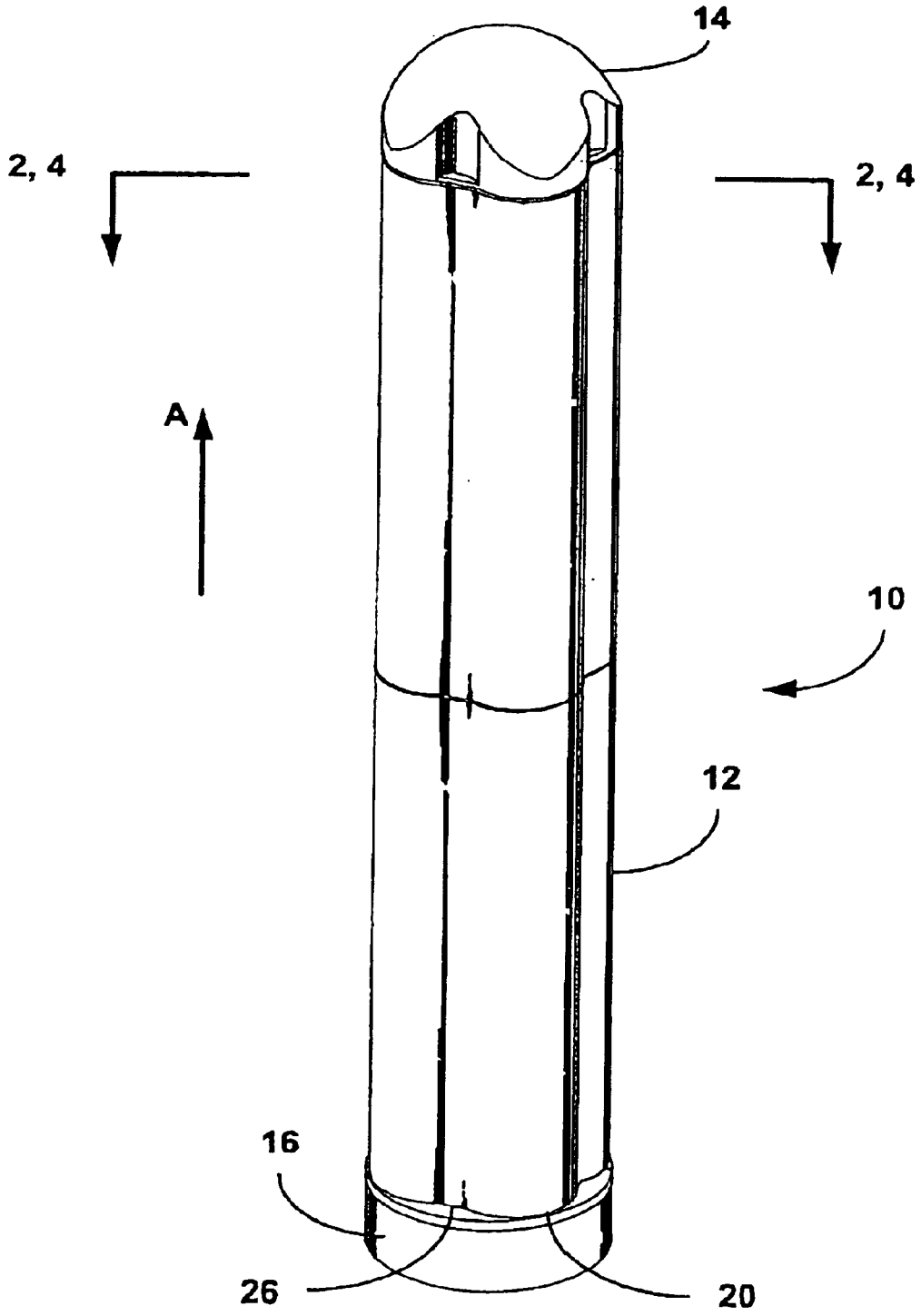
FIG. 1 depicts a side view of the launch capsule assembly of the present invention.

Referring now to FIG. 1 there is shown a launch capsule assembly 10 that will launch by buoyancy a missile or an unmanned aerial vehicle. The launch capsule assembly 10 comprises an elongated main body 12, a top cap 14 and a bottom cap 16.

The main body 12 can be formed by infusing a fiberglass cloth resin over a male mandrel. Additionally, the fiberglass cloth may be infused with epoxy or vinyl ester in circumstances that require additional strengthening of the main body 12. Alternatively, a graphite/epoxy composite may be infused on the mandrel in lieu of fiberglass cloth resin.

Figure 2:
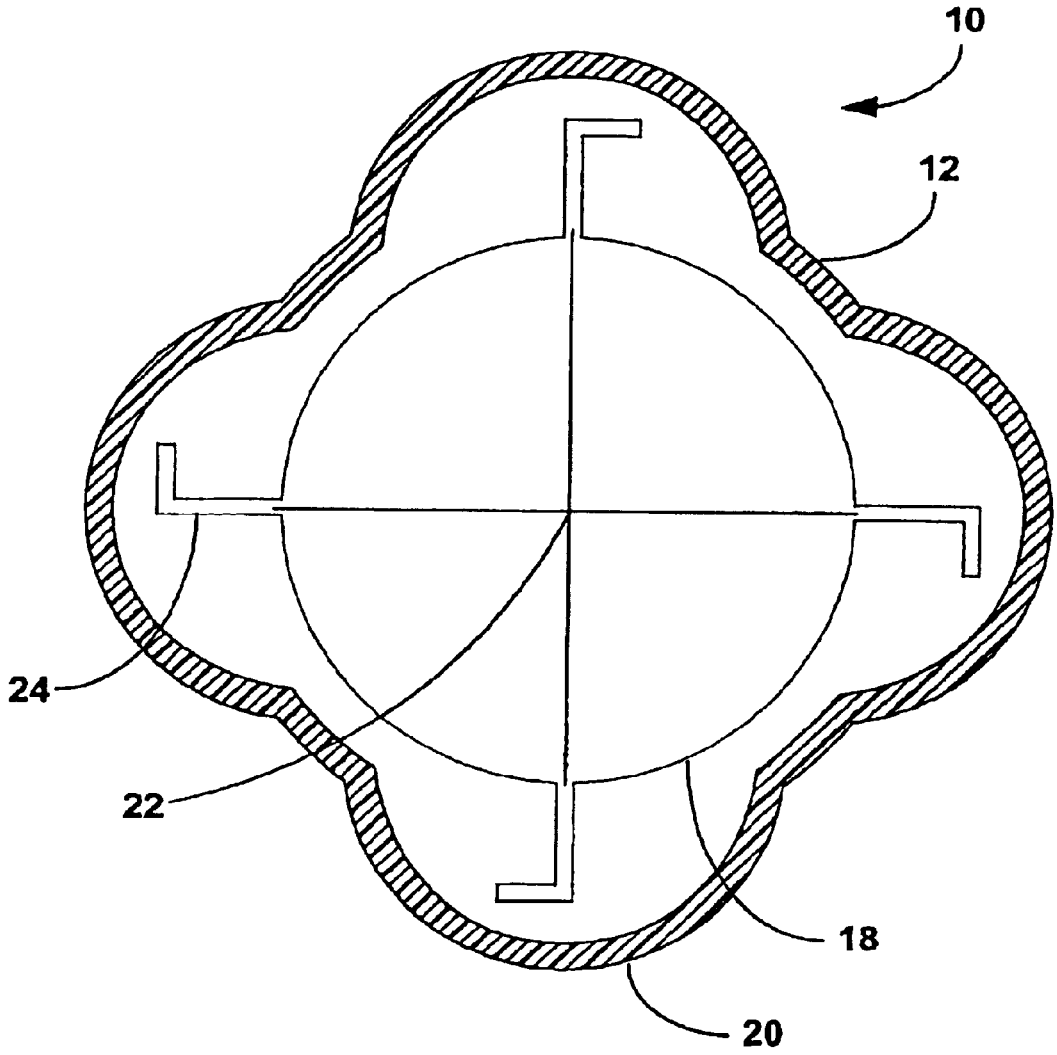
FIG. 2 depicts a cross-sectional view of the main body of the launch capsule assembly with the view taken from reference line 2—2 of FIG. 1.

As shown in the cross-sectional view of FIG. 2, the interior of the main body 12 is sized to accommodate a payload 18 such as a missile or an unmanned aerial vehicle. The main body 12 includes one or more lobes 20 as part of the interior of the body. The lobes 20 project perpendicularly away from the center axis 22 of the main body 12 with the interior of each projecting lobe 20 sized to accommodate at least one projecting wing or fin 24 of the payload 18.

Depending on the type of payload 18 being used and/or the stowage requirements of the launch capsule assembly 10, the size of the lobe 20 may vary to accommodate an extended fin or the folded fin 24 shown in the figure. Additionally, the number of lobes 20 may vary depending on the type of payload 18 and/or the stowage requirements of the launch capsule assembly 10. As shown in FIG. 1, the projecting lobes 20 cover the length of the main body 12 to allow travel of the payload 18 in movement direction A during launch. The lobes 20 also increase the stability of the launch capsule assembly 10 while the launch capsule travels by its buoyant force to the surface in the movement direction "A".

Figure 3:
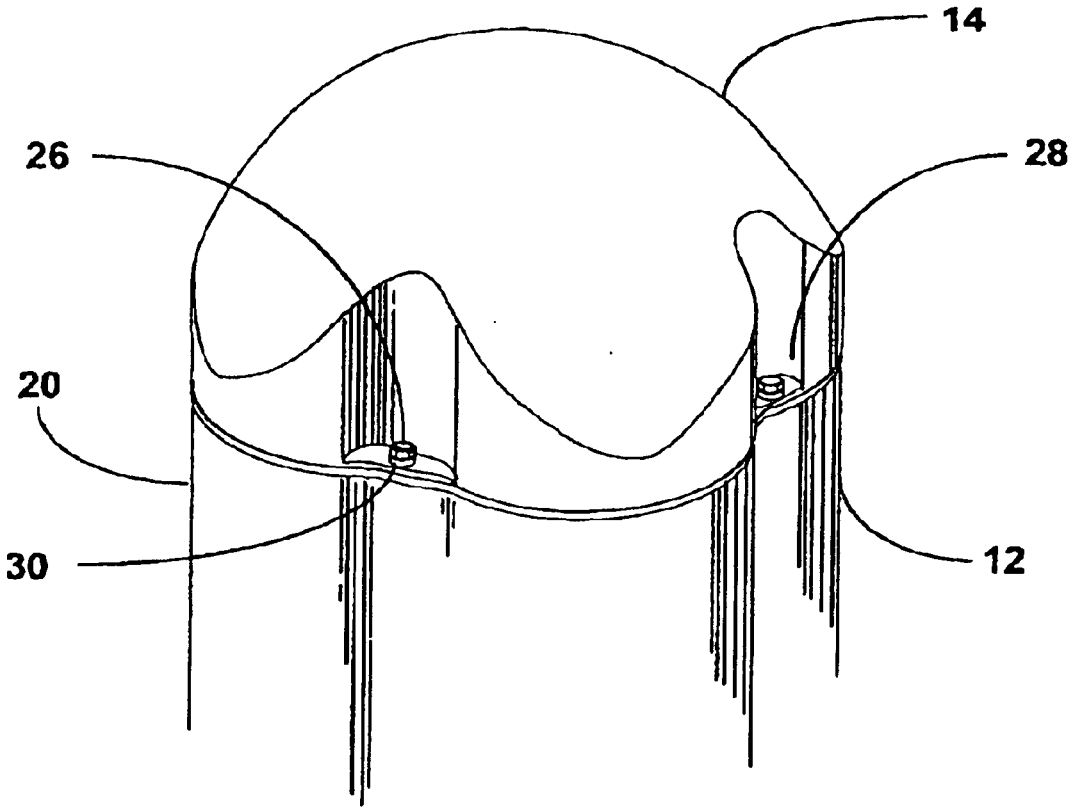
FIG. 3 depicts an enlarged side view of the launch capsule assembly at the attachment point of the main body of the assembly to the top cap of the assembly.

The top cap 14 removably attaches to the main body 12 as shown in detail in FIG. 3. The top cap 14 has a hydrodynamic shape such as a hemisphere or a paraboloid allowing fluid flow thereover. Similar to the main body 12, the top cap 14 can be formed by infusing a fiberglass cloth resin over a male mandrel. In the figure, explosive bolts 26 attach the top cap 14 to the main body 12, with each explosive bolt attached in a recessed pocket 28 of the top cap 14. The explosive bolts 26 are secured to the main body 12 by nuts (not shown) that fit into a threaded aperture 30 in an undercut of the main body. When the launch capsule assembly 10 broaches the water surface, the top cap 14 is removed by the explosive bolts 26. The explosive bolts 26 can be substituted by any other attachment means known to those ordinarily skilled in the art.

In the case of more than one projecting lobe 20, the recessed pockets 28 of the top cap 14 may align with the spacing between the lobes of the main body 12. This alignment of the recessed pockets 28 further enhances the stability of the launch is capsule assembly 10. Additionally, the recessed pockets 28 in conjunction with the hydrodynamically shaped top cap 14 allow ease of travel in movement direction "A" during launch.

Figure 4:
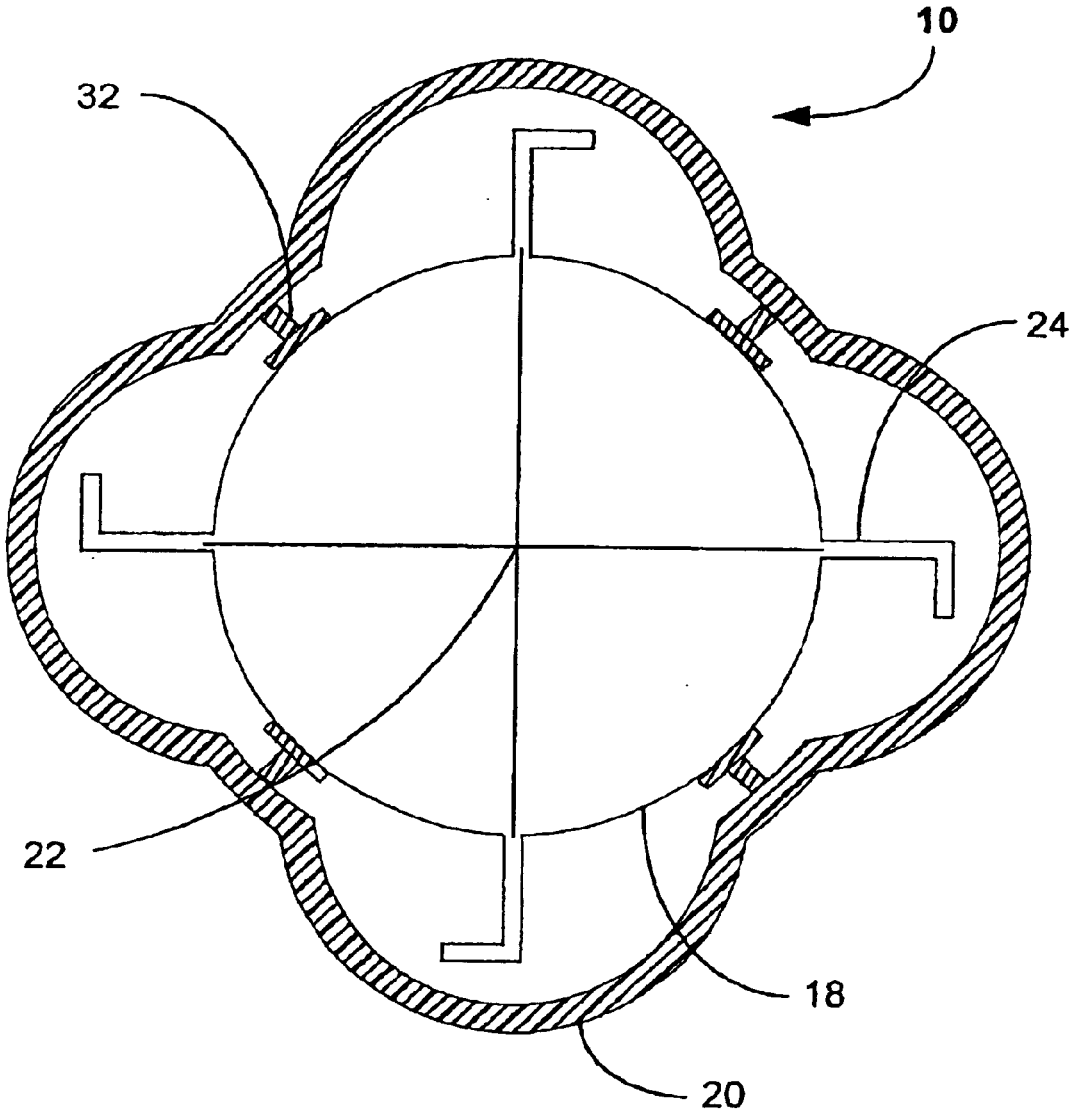
FIG. 4 depicts a variant of the present invention in which the figure depicts a cross-sectional view of the main body of the launch capsule assembly wherein the main body further includes stiffening ribs with the view taken from reference line 4—4 of FIG. 1.
Figure 5:
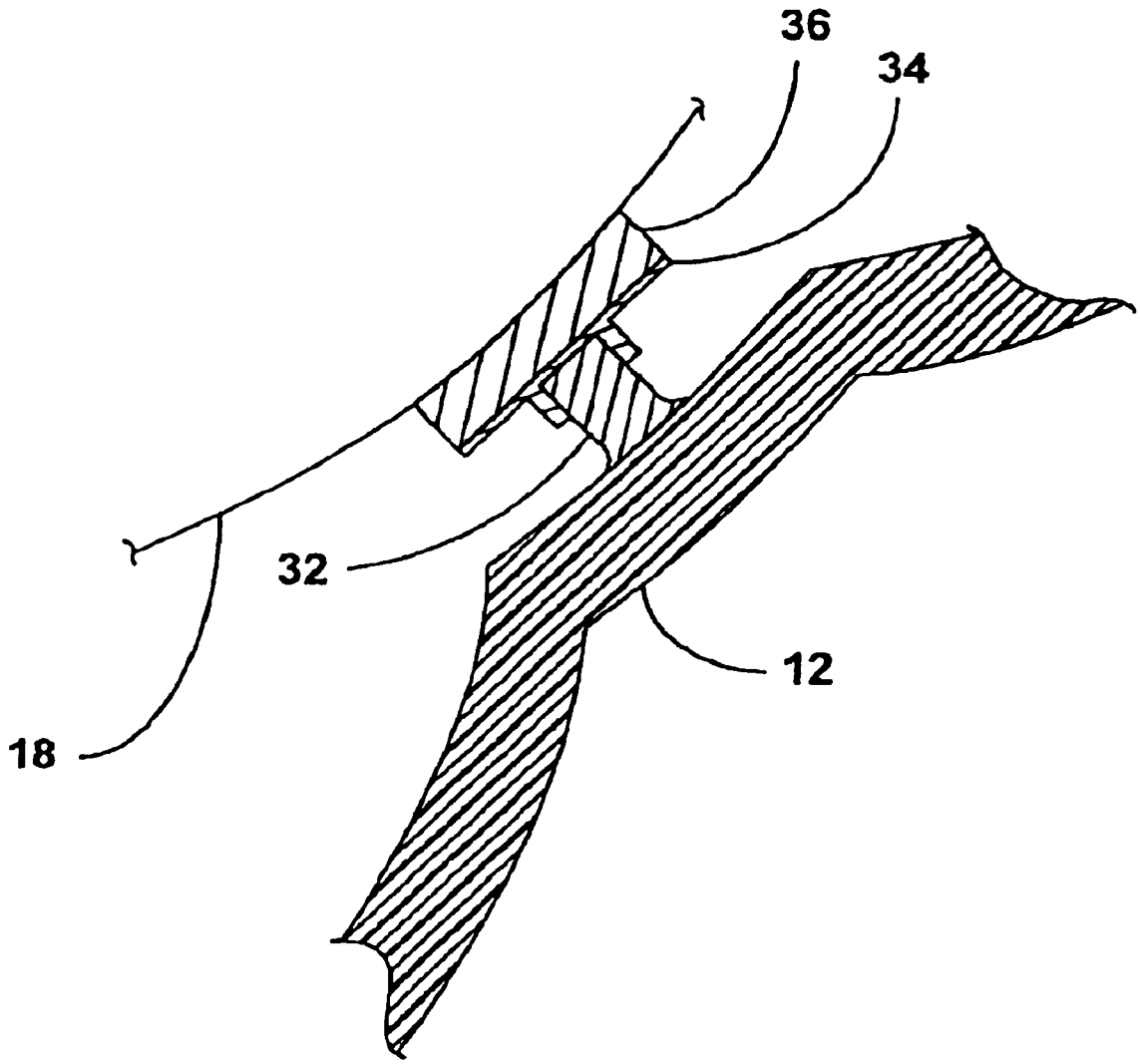
FIG. 5 depicts an enlarged view of a stiffening rib of the main body.

The bottom cap 16 also removably attaches to the main body 12 as shown in FIG. 1. The bottom cap 16 is preferably made from steel and is machined to have a matching cross-section to the main body 12. The bottom cap 16 is attached by bolts (not shown) to undercut of the main body 12 similar to that used for the attachment of the main body to the top cap 14. Explosive bolts 26 or other attachment means known to those ordinarily skilled in the art can also be used for the bottom cap 16, if removal of the bottom cap 16 is required during launch. In a variant of the present invention shown in FIG. 4 and shown in the enlarged view of FIG. 5, the main body 12 further includes stiffening ribs 32. Based upon the strengthening or weight requirements of the launch capsule 10, the stiffening rib 32 may be a built-up area of fiberglass resin cloth as shown in detail in FIG. 5 or a separate section adhering to the main body 12. To provide shock and vibration isolation of the payload 18 and to further stabilize the payload 18, the stiffening rib 32 can additionally comprise a steel shock mount 34 in which the shock mount 34 is coated with an elastomeric material 36.

Obviously many modifications and variations of the present invention may become apparent in light of the above teachings. In light of the above, it is therefore understood that within the scope of the appended claims, the invention may be practiced otherwise than as specifically described.

What is claimed is:

1. A launch capsule assembly for housing a vehicle, said assembly comprising:

an elongated main body with an exterior defining an interior capable of housing the vehicle, and first and second open ends, said main body including at least two lobes formed as part of the exterior, said lobes projecting perpendicularly from a longitudinal axis of said main body and extending from said first open end to said second open end;

a top cap removably attached to the first open end of said main body, said top cap having pockets formed therein, said pockets being in alignment with said main body between said lobes; and attachment means joining said top cap to said main body with said attachment means being positioned at said pockets;

wherein said launch capsule assembly is buoyant.

2. The assembly in accordance with claim 1, wherein the attachment means comprises explosive bolts.

3. A launch capsule assembly for housing a vehicle, said assembly comprising:

an elongated main body with an exterior defining an interior capable of housing the vehicle, and first and second open ends, said main body including at least two lobes formed as part of the exterior, said lobes projecting perpendicularly from a longitudinal axis of said main body and extending from said first open end to said second open end;

a top cap removably attached to the first open end of said main body wherein said main body and said top cap are formed from a fiberglass cloth with resin; and a bottom cap removably attached to the second open end of said main body wherein said launch capsule is buoyant.

4. The assembly in accordance with claim 3, wherein said resin of said main body and said top cap includes epoxy as a strengthening agent.

5. The assembly in accordance with claim 3, wherein said resin of said main body and said top cap includes vinyl ester as a strengthening agent.

6. A launch capsule assembly for housing a vehicle, said assembly comprising:

an elongated main body with an exterior defining an interior capable of housing the vehicle, and first and second open ends, said main body including at least two lobes formed as part of the exterior, said lobes projecting perpendicularly from a longitudinal axis of said main body and extending from said first open end to said second open end;

a top cap removably attached to the first open end of said main body wherein said main body and said top cap are formed from a graphite/epoxy composite; and a bottom cap removably attached to the second open end of said main body wherein said launch capsule is buoyant.

7. A launch capsule assembly for housing a vehicle, said assembly comprising:

an elongated main body with an exterior defining an interior capable of housing the vehicle, and first and second open ends, said main body including at least two lobes formed as part of the exterior, said lobes projecting perpendicularly from a longitudinal axis of said main body and extending from said first open end to said second open end;

a top cap removably attached to the first open end of said main body wherein said launch capsule assembly is buoyant; and stiffening ribs formed integrally with said main body between said lobes of said main body, said stiffening ribs including shock mounts positioned toward said longitudinal axis of said main body wherein said shock mounts are coated with elastomeric material.

8. A launch capsule assembly for housing a vehicle, said assembly comprising:

an elongated main body with an exterior defining an interior capable of housing the vehicle, and first and second open ends, said main body including at least three lobes formed as part of the exterior, said lobes projecting perpendicularly from a longitudinal axis of said main body and extending from said first open end to said second open end;

a top cap having a hydrodynamic shape, said top cap removably attached to the first open end of said main body;

a bottom cap removably attached to the second open end of said main body wherein the periphery of said bottom cap is formed to match a periphery of the second open end of said main body such that said bottom cap includes projecting lobes similar to said main body lobes; and stiffening ribs positioned inside said main body between said lobes of said main body, said stiffening ribs including shock mounts positioned toward said longitudinal axis of said main body wherein said shock mounts are coated with elastomeric material and wherein said launch capsule assembly is buoyant.

* * * * *